United States Patent [19]

Hardman

[11] 4,015,915

[45] Apr. 5, 1977

[54] OIL FREE COMPRESSOR

[76] Inventor: James A. Hardman, 1095 Hyland Lake Drive, Salt Lake City, Utah 84121

[22] Filed: Nov. 20, 1972

[21] Appl. No.: 308,015

[52] U.S. Cl. ..... 417/490; 92/157

[51] Int. Cl.[2] ..... F01L 15/14; F04B 7/04

[58] Field of Search ..... 417/490, 437, 415; 92/153, 157, 249; 74/50

[56] References Cited

UNITED STATES PATENTS

| | | | |
|---|---|---|---|
| 1,478,929 | 12/1923 | Tursky | 92/153 |
| 2,698,394 | 12/1954 | Brown | 74/50 |
| 2,963,217 | 12/1960 | Wysong, Jr. | 92/157 |
| 3,183,848 | 5/1965 | Raymond | 417/269 |
| 3,250,931 | 5/1966 | Hardman | 417/415 |
| 3,398,728 | 8/1968 | Hardman | 123/56 B |
| 3,570,628 | 4/1969 | Rodgers | 92/249 |

FOREIGN PATENTS OR APPLICATIONS

| | | | |
|---|---|---|---|
| 605,968 | 1/1947 | United Kingdom | 74/50 |

*Primary Examiner*—William L. Freeh
*Attorney, Agent, or Firm*—B. Deon Criddle

[57] ABSTRACT

An air compressor utilizing one or more pistons reciprocating within water cooled cylinders and operating in an oil free environment. Each piston is reciprocated by rotation of motor driven, balanced rotors, through a reciprocating and oscillating shuttle member. A centrally sleeved, hollow ball, accommodates shuttle member movement, while interconnecting the shuttle member and the rotors. Positive lubrication is provided for the rotor bearings, the hollow ball and shuttle member and the reciprocating piston shafts. The rotors are driven in opposite directions by motors mounted to maintain constant torque on the rotors.

7 Claims, 7 Drawing Figures

OIL FREE COMPRESSOR

BRIEF DESCRIPTION OF THE INVENTION

1. Field of the Invention

This invention relates to air compressors and is particularly concerned with air compressors discharging oil free air and more particularly with a compressor having pistons reciprocated by rotating rotors, through a reciprocating and rotatably oscillating shuttle member.

2. Prior Art

In my U.S. Pat. No. 2,480,854, there is shown a motion transforming mechanism whereby rotary motion is transformed into reciprocating motion, or vice versa, through a reciprocating and oscillating shuttle member. This motion transforming mechanism or the principals thereof have since been used in various types of volume displacement structures, as shown for example, in my U.S. Pat. Nos. 3,168,047 and 3,250,931 and in an engine, as shown in my U.S. Pat. No. 3,398,728. While the motion transforming mechanism, as used in these patented devices, has been generally acceptable, there has been shown to be a need for a mechanism in which heat and wear at the coupling between the shuttle member and the opposed rotors are significantly reduced and wherein lubrication is positively provided to the couplings and to reciprocating shafts on which pistons are mounted to operate in an oil free environment.

My previously issued patents also disclose a variety of ways for lubricating the shuttle member, bearings for the rotating input or output shafts and the couplings between the shuttle member and the rotors. Such lubrication systems have been satisfactory for many purposes but in some instances have contributed to wear on cooperable surfaces through the washing away of wear particles exposed during interaction of the wear surfaces.

SUMMARY OF THE INVENTION

Principal objects of the present invention are to provide an oil free compressor having at least one lightweight piston operating in an oil free environment while providing full lubrication to piston drive shafts, input shaft bearings and couplings between rotors and a reciprocating and oscillating shuttle member.

Other objects are to provide coupling means between rotors and shuttle member of such a compressor, such that maximum wear characteristics and heat dissipation are obtained.

Still other objects are to provide such a compressor wherein the rotors are driven by matched motors arranged to drive the rotors in opposing directions and mounted to be self-adjusting, whereby a uniform and equal torque drive is applied through the rotors to eliminate piston side wall thrust.

Principal features of the invention include at least one pick-up oiler and stripper structure arranged to pick up oil and to carry it on rotor peripheries and to direct the oil attaching to the rotors into paths for oiling the rotor shaft bearings, the couplings between rotors and shuttle member and the reciprocating piston drive shaft.

The couplings between rotors and shuttle member include lightweight rotatable ball members having a central shuttle member receiving passage and hollowed walls so that destructive heat developing at the coupling will be rapidly dissipated and through which walls lubricating oil can be directed or circulated at any desired pressure to further dissipate heat developing at the coupling. Any guide bearings which may be used to guide the piston drive shaft can also be lubricated by the same circulating oil.

In the natural function of the disclosed ball and socket arrangement, the socket can only be arranged to cover part of the ball surface at any given time. Part of the ball surface is therefore constantly exposed to a washing action by the oil. By constructing the rotatable ball member from steel or other relatively hard metal, which may be readily hard face or chrome plated if desired and retaining seat or socket for the ball of a softer material, such as bronze, this erosion process is eliminated. With this construction, the softer seat, which is more subject to deterioration during use it not subjected to the washing action and does not pit and wear away as fast as does a ball constructed or softer material than the seat in which it is used.

Additional objects and features will become apparent from the following detailed description, taken together with the accompanying drawings.

THE DRAWINGS

FIG. 1 is a perspective view of a compressor of the invention, taken from above and at one cylinder end;

FIG. 2, an exploded perspective view of the mounting plates used to mount the compressor and the drive motors thereof;

FIG. 3, a fragmentary top plan view with one half of the compressor centrally cut away to show one of the cylinder assemblies and one of the rotor drive members in horizontal section and with the portions within lines A—A and B—B rotated from a vertical to a horizontal position for clarity;

FIG. 4, an enlarged, fragementary, somewhat diagramatic view showing the oil pick-up and stripper mechanism and the oil guides;

FIG. 5, a view taken on the line 5—5 of FIG. 4, showing the oil stripper mechanism pivoted during assembly of the rotor and rotor housing cover plate;

FIG. 6, a view like that of FIG. 5, but showing the rotor and rotor housing cover plate in assembled condition; and FIG. 7, an enlarged, fragmentary, horizontal section view of another embodiment of the ball and socket coupling between the rotors and the shuttle member.

DETAILED DESCRIPTION

Figure 1:
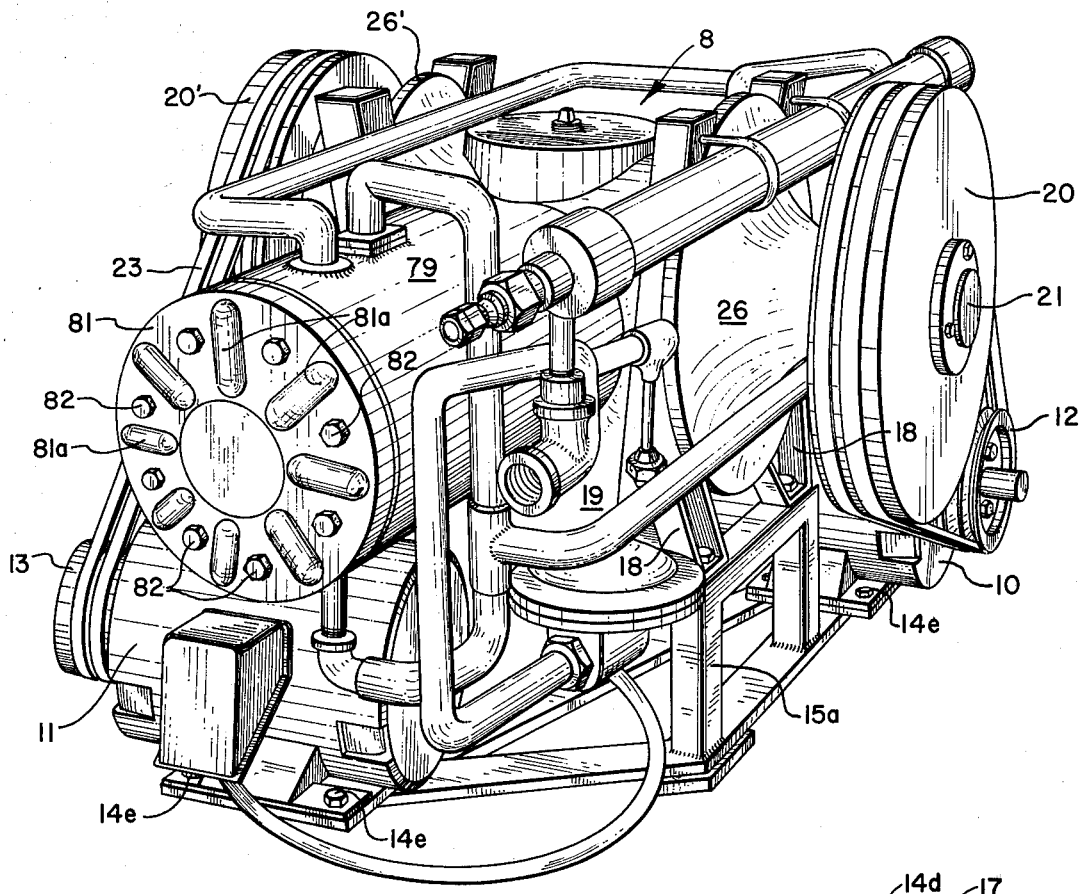
Figure 2:
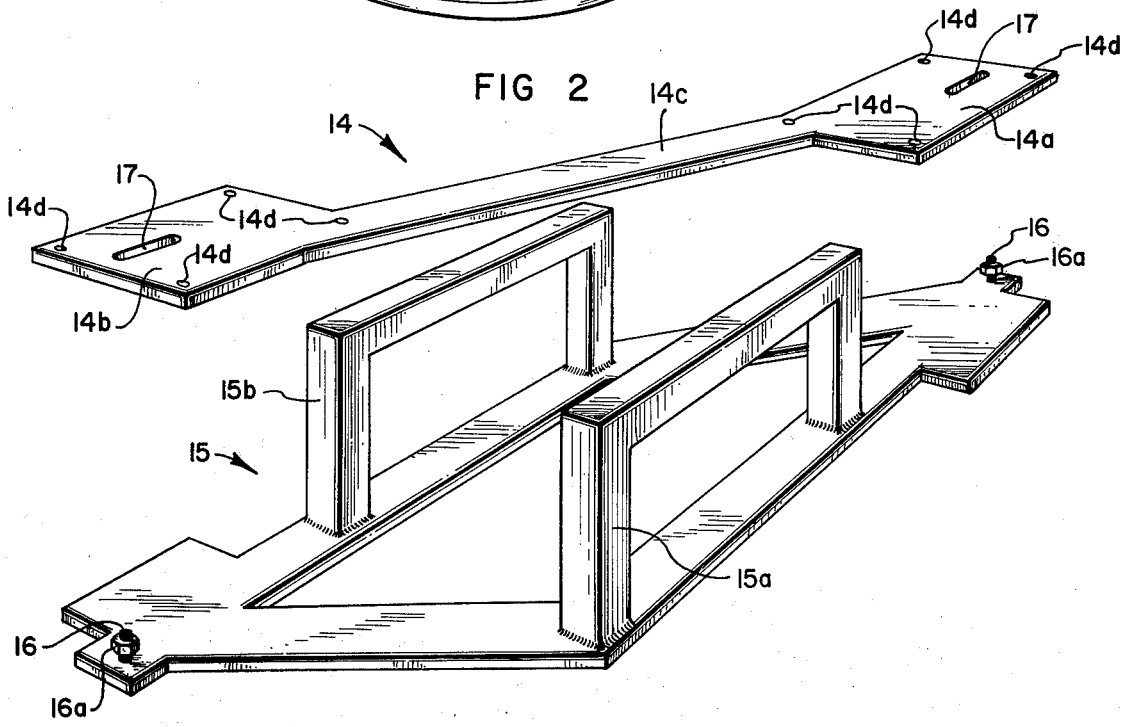
Figure 3:
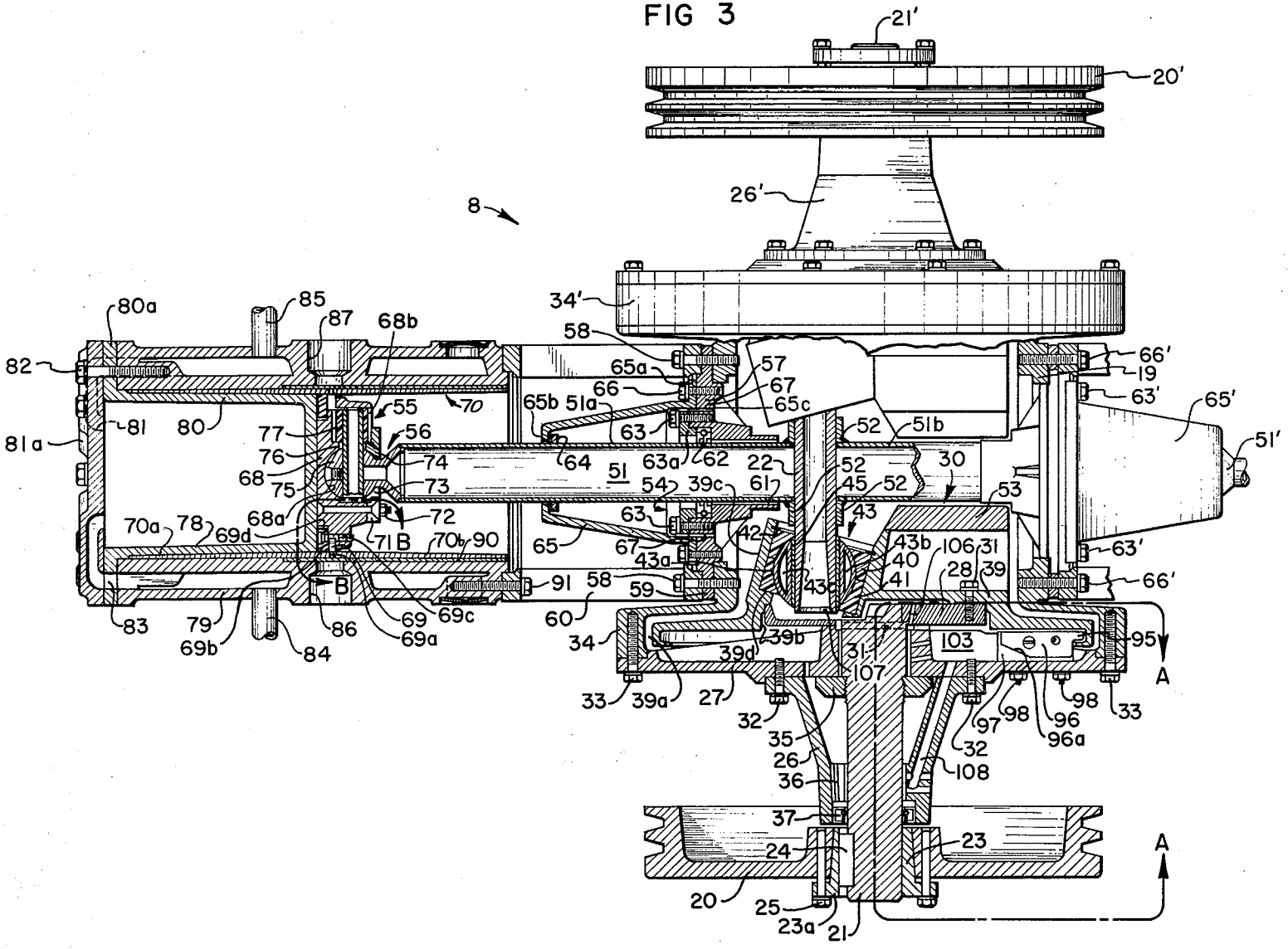

In the presently preferred embodiment, the compressor of the invention, shown generally at 8, is powered by two matched electric motors 10 and 11, respectively having drive pulleys 12 and 13 fixed on the output shafts thereof. The motors 10 and 11 are mounted at opposite ends of a motor mounting member shown generally at 14, on motor mounting plates 14*a* and 14*b*, respectively, that are rigidly interconnected by an arm 14*c*, and are arranged to be positioned at diagonally opposite cylinder ends of the compressor. Holes 14*d* are provided through the mounting plates and bolts 14*e* are inserted through mounting bases or plates provided therefor on the bottoms of the motors and through the holes 14*d* to secure the motors to the mounting plates. The motor mounting member extends diagonally across the corners of a parallelogram base 15 such that studs 16 projecting upwardly from the most distant corners of the base are inserted through parallel slots 17 provided therefore through the mounting plates 14*a* and 14*b*. Nuts 16*a* are adjusted onto studs 16 to hold the mounting plates thereover in a free sliding position.

The compressors 8 has feet 18 projecting from the compressor housing 19 to rest on mounting brackets 15*a* and 15*b* that project upwardly from central opposite sides of the base 15. The feet 18 are bolted or otherwise affixed to the mounting brackets. With the motors and compressor so arranged pulleys 12 and 13 are respectively aligned with flywheel type pulleys 20 and 20' that are affixed to input shafts 21 and 21' of the compressor 8. The electric motors are matched and are wired in parallel so that they will drive uniformly. If, however, one motor should apply a greater torque force to its pulley 20 or 20', the mounting member 14 will move with respect to the studs 16 to allow belts 22 and 23, respectively, interconnecting pulleys 12 and 20 and pulleys 13 and 20' to be maintained in equal tension. While it is possible, as disclosed in my aforesaid U.S. Pat. No. 3,250,931 to directly drive the input shafts of a compressor of the type herein disclosed with matched motors, it has for some applications, been found desirable to effect speed reductions, between the output of the motors and the input shafts of the compressor. With the mounting member, base plate, motor pulley and belt arrangement heretofore described a desired speed reduction dependent on the relative sizes of the pulleys used will be obtained, and a substantially uniform driving torque will be applied to the oppositely arranged input shafts.

The pulleys 20 and 20' are identically constructed and are coupled to a reciprocating and oscillating shuttle member 22 in the same manner. Thus, a description of pulley 20 and the structure connecting the pulley to the shuttle member and the housing structure for such connecting structure should be understood as being similarly applicable to pulley 20' and its related structure. Similarly, throughout the description prime numbers are used to identify parts identical to those having the corresponding principal numbers.

Pulley 20 is fixed to compressor input shaft 21 through a hub 23 that is keyed to the shaft by a key 24 and bolts 25 that are threaded through a flange 23*a* of hub 23 and into a boss of the pulley.

Compressor input shaft 21 extends through an input shaft housing 26 and a rotor housing cover plate 27 before being rigidly connected or welded to a collar 28 comprising part of the input shaft 21. A rotor, shown generally at 30, is bolted or otherwise assembled to the collar 28 by bolt 31. Bolts 32 secure the input shaft housing 26 to the cover plate 27 and bolts 33 secure the cover plate to a rotor housing 34 (comprising part of housing 19) the lower portion of which is filled with a suitable lubricating oil. A nut 35, threaded onto shaft 21 holds the shaft in place with respect to plate 27 and the shaft is journaled through bearings 36 pressed into the input shaft housing 26. A wiping seal 37, also press fitted into the housing 26, engages shaft 21 and prevents lubricant loss out of the housing, as will be further described.

Rotor 30 includes a plate member 39 having an inturned peripheral flange 39*a* and a dished out central portion 39*b* into which the collar 28 is mounted. An eccentrically located cylindrical extension 39*c* projects from plate member 39 and a pair of ball seat members 40 and 41 are fitted inside the cylindrical extension and are held in position between the shoulder 39*d* and a snap ring 42. The ball seat members 40 and 41 are ring shaped and have matched, spherically arcuate inner surfaces that jointly form one larger spherically arcuate surface within which a portion of a ball 43 is positioned.

Ball 43 has a spherical, smooth outer wall 43*a* with a tubular member 43*b* inserted therethrough and welded or otherwise affixed in place. A space 43*c* is formed between tubular member 43*b* and the wall 43*a*, to reduce the weight of the ball and for cooling purposes as will be hereinafter further explained. Ball 43 is constructed of a harder material than is the arcuate surface formed by seat members 40 and 41 and portions of the spherical surface of the ball rotate out from within the seat during movement of the ball, as will be hereinafter explained. In practice, it has been found very satisfactory to form the seat members 40 and 41 of bronze material and the outer wall 43*a* of steel, which may or may not be chrome plated, as desired. A sleeve 45 is tightly fitted within tubular member 43*b* to provide a bearing surface for one end of the reciprocating and oscillating shuttle member 22. The other end of the shuttle member is inserted into a similar ball (not shown) that is connected to shaft 21' in the same manner as ball 43 is connected to shaft 21.

In operation, simultaneous rotation of pulley 20 in one direction by motor 10 and of pulley 20' in the opposite direction by motor 11 will revolve the rotor members in opposite directions, reciprocate and oscillate the shuttle member and reciprocate and rotationally oscillate a piston shaft 51 that has its center journaled around the shuttle member. Extensions 52 which form a part of piston shaft 51, provide a sleeve type mounting journal into which the shuttle is fixed. The manner in whch the rotary motion is converted into reciprocating linear motion is fully explained in my aforementioned U.S. Pat. No. 2,480,854, and will not be further explained in detail herein.

A counterweight 53 is affixed to each rotor to counterweight the reciprocating piston rod and pistons and the swinging force of the associated orbiting ball and socket. The counterweights are placed as close to the reciprocating piston shaft 51 as space and parts limits will permit.

The piston rod 51 is hollow and the opposite projections thereof from the shuttle member are supported by and are connected to identical piston structure. As a result, only one such projection 51*a* and its support structure and the structure connected thereto will be hereinafter described and it will be apparent that similar structure would be similarly used with the projection 51*b*.

Projection 51*a* extends slidably through a stuffing gland, shown generally at 54, and is connected to a sleeve type piston 55 through an articulated coupling 56.

The stuffing gland 54 comprises a cover plate 57 that covers an opening through housing 19 and is clamped by bolts 58 between housing 19 and one annular flange 59 of an open walled cylinder extension 60. Cover plate 57 has an opening 61 through which the piston shaft can reciprocate and wiper seals 62 are clamped to the cover plate by bolts 63 and a ring 63*a*, such that the seals are in continuous engagement with the piston shaft 51.

An oil slinger collar 64 is fixed to and projects from the piston shaft and a housing 65 of truncated cone configuration has a base flange 65*a* secured by bolts 66 to cover plate 57. A top portion 65*b* of the housing 65 overlaps the collar 64 and is closely spaced from the piston shaft. Small ports 65*c* through the plate 57 allow oil flow from within housing 65 to housing 19, as will be further explained.

The piston 55 is of the same general configuration as the piston shown in my previously mentioned U.S. Pat. No. 3,250,931 in that it has a piston head and skirt members projecting therefrom. In the present construction a piston mounting ring 69 is fixed to piston skirt portions 70*a* and 70*b* at 69*a*, with the skirt portions respectively extending in opposite directions from the mounting ring. A retaining ring 69*b* mates with the outer edge of head 68 and with bolts 69*c* clamps the mounting ring 69 between the retaining ring and the head 68. Thus, the piston head and skirt will reciprocate together. A small space is provided between retaining ring 69*b* and the portion of head 68 the retaining ring encircles.

The apertures in the piston mounting ring 69 through which the bolts 69*c* are inserted are half holes and are oversized to permit a slight radial movement of the bolts therein. The portion of the head 68 into which bolts 69*c* are threaded is also spaced from the skirt 70.

A clamping ring 71, held in place by bolts 72, secures a pair of semi-circular socket members 73 and 74, to form with a semi-spherical recess 68*a* in the head, a socket for a ball 75 formed on the end of piston shaft 51.

To impart rotation to the piston from the piston rod, a roll pin 76 extends centrally through the ball 75, transverse to the axis of the piston shaft and has its ends inserted in bushings 77 that are mounted tightly within the faces of slots 68*b* provided therefor in head 68. The clamping ring 71 additionally holds the bearings 77 in place. Roll pin 76 insures swinging of the piston rod with respect to the piston and, since the bushings 77 can move slightly in grooves 68*b* a small amount of rocking movement of the ball in the socket is allowed to compensate for very small magnitude misalignment of the piston shaft, the piston 55, and the cylinder 78 in which the piston reciprocates.

Cylinder 78 is formed in a housing 79, the walls of which are made hollow so that water or other suitable coolant can be circulated therethrough.

A cup member 80 has a flange 80*a* adapted to rest against the end of housing 79 and adapted to be clamped between the housing and an end plate 81 by bolts 82 inserted through the end plate and the flange and threaded into the housing. Bosses 81*a* on the end plate provide flow paths for coolant and interconnect the interiors of the walls of housing 79 with the interior of cup member 80 through ports 83 provided therefor in the flange and through corresponding ports in the wall of the housing.

The piston skirt 70, including oppositely extending portions 70*a* and 70*b*, is adapted to reciprocate within a space formed between the housing and the cup member 80. Water circulated through an inlet pipe 84, the wall of housing 79, the end plate 81, cup member 80, the wall of the housing again and outlet pipe 85, carries away heat build-up from the piston skirt and piston head.

An air intake port 86 opens into the cylinder 78 and a discharge port 87 opens from the cylinder. While only one of each of these ports is herein illustrated, it will be apparent that as many sets of intake and exhaust ports can be provided as may be desired. Also, while not shown herein, it will be apparent that ports will be provided through the piston skirt to cooperate with the intake and exhaust ports provided in the same manner as disclosed in my aforementioned U.S. Pat. No. 3,250,931.

A Teflon sleeve or liner 90 of desired length fits in a recess provided therefore in cylinder 78 to provide a lubricated surface against which the piston skirt can travel and the housing 79 is secured by bolts 91 to cylinder extension 60. In operation, as the piston 55 reciprocates and rotationally oscillates, the skirt thereof travels into the space formed between cup member 80 and housing 79 and the heat developed during this compression stroke is dissipated through the water cooled housing walls and cup member. The skirt 70 extends beyond both ends of the Teflon liner during all operation and, as a result, the liner surface cannot slough off since it is always held in place by the reciprocating and turning skirt.

During the intake stroke of the piston the portion 70*b* of the skirt member 70 is moved into the open walled cylinder extension 60 and is fully air cooled by air circulated through the open cylinder extension.

With the piston 55 constructed as described, maximum piston life is obtained. This construction allows for normal piston head expansion as a result of heat build-up during the expansion stroke and allows the piston weight to be greatly reduced. The head 68, for example, can be made of reinforced aluminum to save weight and operating mass and the mounting ring 69 and skirt 70 can be of steel. Since the skirt and mounting ring are in close proximity to the water cooled housing walls and cup member, heat is dissipated therefrom sufficiently fast to prevent damage. The central portion of the piston, i.e., piston head 68 is allowed to expand and the spaces between the head and ring 69*b*, the bolts 69*c* and the oversized half holes in ring 69 and the space between the head 68 and skirt 70, is sized to permit such expansion.

Lubrication for the bearings through which the input shafts are journaled and for the ball and socket in which the shuttle operates is provided by a pick-up system on the rotor 30.

The inturned peripheral flange 39*a* of rotor plate 39 rotates into the lower portion of housing 19 and collects oil in the groove formed by the flange. The oil collected therein is held in the groove by centrifugal force and is carried to the upper portion of the rotor housing where at least some of the collected oil is stripped from the groove by a finger 95 that projects into the groove.

Finger 95 is formed as a projection of a pivot plate 96 that is connected to a mounting plate 97. The mounting plate 97 is angled and has one leg 97*a* bolted by bolts 98 to the inside face of the rotor housing cover plate and another leg 97*b* projecting from the cover plate into the rotor housing. Direct plate 96 is pivotally mounted to leg 97*b* by a bolt 99 inserted through the leg 97*b* and the plate 96 and a nut 100 that is threaded onto the bolt. A spring 101 is positioned between the head of the bolt and the pivot plate to bias the pivot plate against the leg. A projection 102 on the pivot plate is arranged to fit into a recess 102′ on the leg 97*b* when the finger 95 is in position projecting into the groove formed between flange 39*a* and the rotor plate. The spring loaded pivot mounting allows the pivot plate to be pulled away from leg 97*b*, thereby moving projection 102 from recess 102′, and to be pivoted around bolt 99 as an axis. The leg can therefore be rotated during assembly to allow the finger 95 to be placed in the peripheral groove of the rotor plate 39. The pivot plate is cut away at 96*a* to insure full clearance of the pivot plate during rotation. When the finger 95 is extending into the groove it is closely spaced from the flange 39*a* and the rotor plate 39 such that it does not interfere with free rotation of the rotor but such that oil being centrifugally carried is caught on the finger and falls from the groove.

Figure 4:
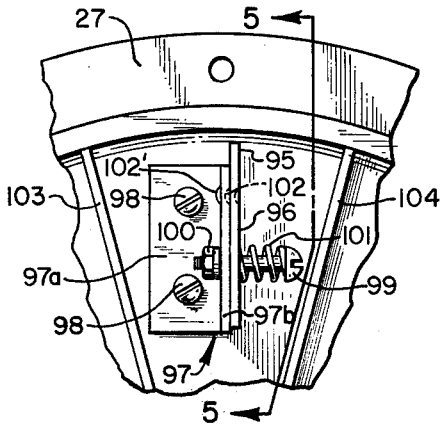
Figure 5:
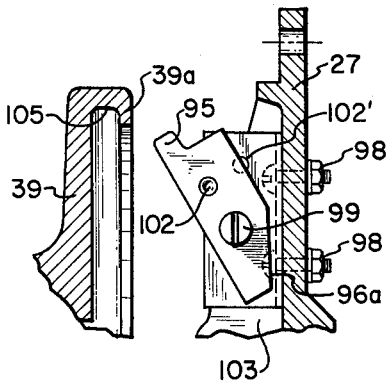
Figure 6:
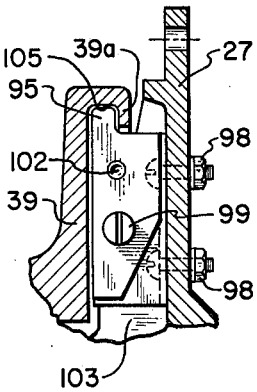

Ribs 103 and 104 on the inside face of the rotor housing cover plate form a channel 105, FIG. 4, in which oil stripped off the rotor by the finger 95 is directed. The ribs flare outwardly away from the cover plate and direct the oil to passages 106 through the passages 106 and into a space 107 and then to the ball 43 and socket 40, 41. At the same time, oil from the channel 105 flows through passages 108 in the wall of the input shaft housing 26 to the bearings 36 through which the input shaft is journaled. The wiper seals 37 engage the input shaft 21 to prevent loss of oil between the shaft and its housing, and ports 109 allow excess oil to drain back into the rotor housing.

As the ball and socket couplings, the rotors, and the shuttle member operate they agitate the oil in housing 19. The agitated oil works through the space between the piston shaft and the cross head to lubricate the piston shaft. Wiper seals 62 generally prevent movement of the oil along the piston shaft to the oil free environment of the piston, but if some oil should get past the seals 62 the oil will be centrifugally discharged from the slinger collar 64 in the manner previously described and will follow the wall of housing 65 and pass through ports 67 back to the reservoir, formed by the lower part of housing 19.

The oil in space 107 bathes the ball and socket and lubricates the portion of the ball moving out from inside the socket. As that portion of the ball again moves inside the socket, a film of lubricant is applied to the socket to reduce wear and to carry away head build-up. As previously noted, the ball surface is harder than the surface of the socket and the softer socket surface is not exposed to any direct washing action of the oil or to the carrying away of loosened wear particles.

Because of the hollow construction of the ball, the bearing surfaces subjected to frictional engagement are largely separated. This gap between the surfaces eliminates much of the heat transfer between the surfaces common to solid ball construction.

While the description heretofore given has been directed to one rotor, coupling member between rotor and shuttle member, piston shaft, piston and piston cylinder, it is to be understood that two of each are provided in the embodiment shown. Also, while the various features are illustrated and described in connection with an oil free compressor, it should be apparent that they have other uses as well. For example, the particularly described ball and socket coupling between the rotors and the shuttle member could as well be used in an engine or a combination engine compressor utilizing the same mechanical movement.

Figure 7:
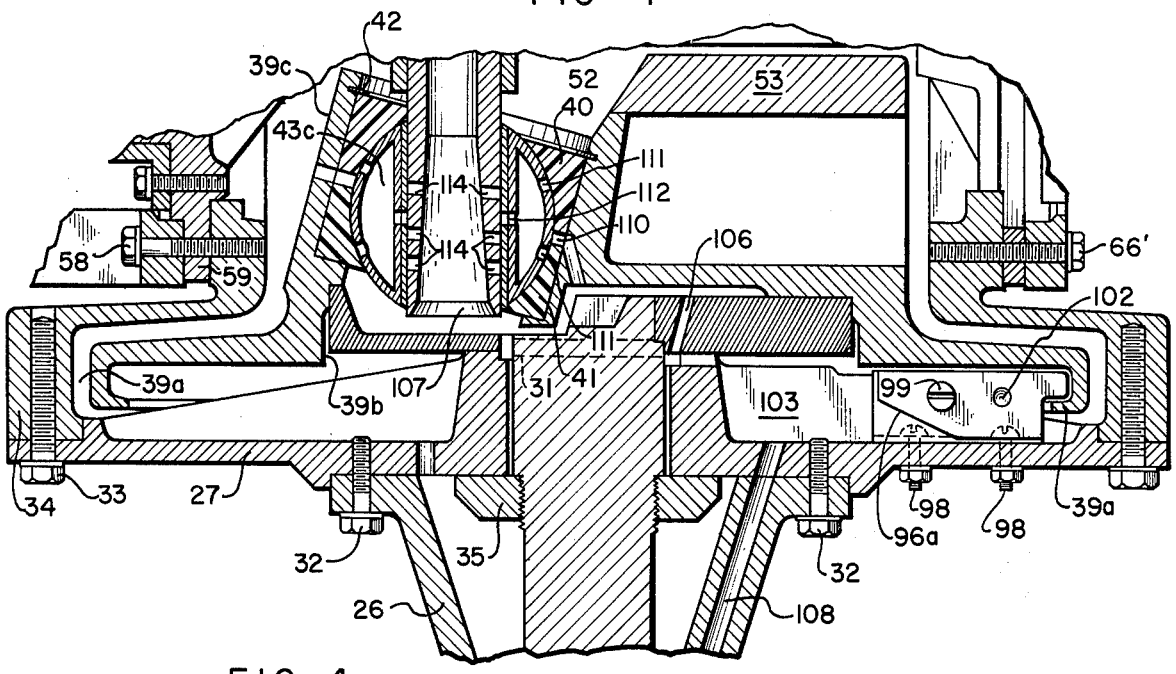

The same hollow ball unit previously described can also be provided with oil ports through both the outer and inner walls to further insure positive lubrication of the surfaces between the ball and the shuttle member should this be desired. As shown in FIG. 7, in this construction, ports 110 are provided between the ring-shaped split socket members; multiple ports 11 are provided through the outer walls of the ball and ports 112 are provided through the inner wall. So constructed oil can flow into the ball and through the ports to even more effectively lubricate the surfaces subjected to wear and to dissipate heat build-up. In the embodiment shown, a passage 113 through the rotor will allow oil through the rotor to port 110. Additional circulation can be obtained by the use of ports 114 in the ends of the shuttle member. The reciprocating shuttle acts as a pump to effectively circulate and distribute the oil from space 107.

It should also be apparent that while the air compressor shown has an oiling system that is both efficient and economical and that is therefore particularly useful to machines of the type described that operate at relatively low speeds, the ported ball coupling of FIG. 7, can be used either with such relatively slow operating units or with faster operating units having a positive feed oil pump. Such an arrangement, using a positive feed oil pump is disclosed, for example, in my previously mentioned U.S. Pat. No. 3,250,931.

Although preferred embodiments of my invention have been herein described, it is to be understood that variations are possible without departing from the scope of the hereinafter claimed subject matter, which subject matter I regard as my invention.

I claim:

1. An oil free compressor comprising at least one input shaft;

means mounting each said input shaft for axially rotational movement;

a rotor fixed to and rotatable with each said input shaft;

a shuttle member;

means coupling each said rotor to one end of the shuttle member, said means including a metal ball member in which said shuttle member reciprocates and rotationally oscillates and a metal socket fixed to and carried by said rotor and surrounding a portion of said ball member, the surface of the ball member engaging the socket being harder than the surface of the socket that engages the ball member;

means for lubricating the engaging surfaces of the ball member, and the shuttle member and the ball member and the socket, said means for lubricating including an oil tight rotor housing having oil therein into which the rotor dips during rotation of the rotor, a groove formed around the rotor, stripper means at an upper part of the housing extending into the groove to block oil centrifugally held in the groove, and means for directing oil from the stripper means to the means coupling each said rotor to the shuttle member;

a piston shaft journaled on said shuttle member and secured against movement axially therealong;

a compressor cylinder; and piston means in said cylinder, connected to said piston shaft and reciprocal and rotatable with said piston shaft whereby air input and output from said cylinder is regulated by said piston means.

2. A compressor as in claim 1, wherein the stripper means comprises a finger extending into the groove.

3. A compressor as in claim 2, further including means for lubricating the input shaft, said means including the stripper means.

4. A compressor as in claim 2, further including means to prevent lubricant moving along the piston shaft to the compressor cylinder.

5. A positive displacement means comprising at least one input shaft;

means mounting each said input shaft for axially rotational movement;

a rotor fixed to and rotatable with each said input shaft;

a shuttle member;

means coupling each said rotor to one end of the shuttle member, said means including a metal ball member in which said shuttle member reciprocates and rotationally oscillates and a metal socket fixed to and carried by said rotor and surrounding a portion of said ball member, the surface of the ball member engaging the socket being harder than the surface of the socket that engages the ball member;

means for lubricating the engaging surfaces of the ball member, and the shuttle member and the ball member and the socket;

a piston shaft journaled on said shuttle member and secured against movement axially therealong;

a piston cylinder;

piston means in said cylinder, connected to said piston shaft and reciprocal and rotatable with said piston shaft whereby air input and output from said cylinder is regulated by said piston means;

a pair of oppositely positioned input shafts;

means coupling each of said shafts to said shuttle means;

drive means for rotating said shafts in opposite directions, said drive means including matched electric motors and belts interconnecting pulleys on the motors and pulleys on the input shafts; and means for maintaining the torque application from said motors to said input shafts equal.

6. A compressor as in claim 5, wherein the means for maintaining the torque application from said motors to said input shafts equal comprises a parallelogram base;

a motor mounting member having motor mounting plates to which the motors are fixed, spaced apart by a rigid arm; and means mounting the motor mounting member on the base whereby the motors and motor mounting member move to compensate for variation of torque application from the motors.

7. A positive displacement means comprising at least one input shaft;

means mounting each said input shaft for axially rotational movement;

a rotor fixed to and rotatable with each said input shaft;

a shuttle member;

means coupling each said rotor to one end of the shuttle member, said means including a metal ball member in which said shuttle member reciprocates and rotationally oscillates and a metal socket fixed to and carried by said rotor and surrounding a portion of said ball member, the surface of the ball member engaging the socket being harder than the surface of the socket that engages the ball member;

means for lubricating the engaging surfaces of the ball member, and the shuttle member and the ball member and the socket;

a piston shaft journaled on said shuttle member and secured against movement axially therealong;

a piston cylinder;

piston means in said cylinder, connected to said piston shaft and reciprocal and rotatable with said piston shaft whereby air input and output from said cylinder is regulated by said piston means, said piston means including a piston head, a piston skirt surrounding said piston head, and means coupling said piston head to said piston skirt intermediate the said skirt whereby the skirt is movable with said piston head and the piston head is expansible within the skirt.

* * * * *